US011749469B2

(12) United States Patent
Flaherty, IV

(10) Patent No.: US 11,749,469 B2
(45) Date of Patent: Sep. 5, 2023

(54) COAXIAL SWITCHES AND METHODS FOR USING THE SAME

(71) Applicant: CORNING OPTICAL COMMUNICATIONS RF LLC, Glendale, AZ (US)

(72) Inventor: Thomas Edmond Flaherty, IV, Surprise, AZ (US)

(73) Assignee: CORNING OPTICAL COMMUNICATIONS RF LLC, Glendale, AZ (US)

( * ) Notice: Subject to any disclaimer, the term of this patent is extended or adjusted under 35 U.S.C. 154(b) by 39 days.

(21) Appl. No.: 17/488,106

(22) Filed: Sep. 28, 2021

(65) Prior Publication Data

US 2022/0102083 A1 Mar. 31, 2022

Related U.S. Application Data

(60) Provisional application No. 63/085,885, filed on Sep. 30, 2020.

(51) Int. Cl.
*H01H 1/14* (2006.01)
*H01H 9/02* (2006.01)

(52) U.S. Cl.
CPC ..... *H01H 1/14* (2013.01); *H01H 9/02* (2013.01)

(58) Field of Classification Search
CPC . H01H 1/14; H01H 9/02; H01H 71/08; H01R 9/05; H01R 18/32; H01R 12/00; H05K 1/00
USPC ..... 200/239; 439/63, 188
See application file for complete search history.

(56) References Cited

U.S. PATENT DOCUMENTS

| | | | | |
|---|---|---|---|---|
| 6,439,906 | B1 | 8/2002 | Gray et al. | |
| 6,520,785 | B2 * | 2/2003 | Hida | H01R 24/46 200/51.09 |
| 6,729,890 | B2 | 5/2004 | Shin | |
| 6,932,615 | B1 * | 8/2005 | Yeo | H01R 24/46 439/63 |
| 7,891,979 | B2 | 2/2011 | Chien et al. | |
| 8,011,939 | B2 | 9/2011 | Braem et al. | |
| 9,281,369 | B2 | 3/2016 | Yang | |
| 9,692,151 | B2 | 6/2017 | Kunieda et al. | |
| 2004/0002245 | A1 | 1/2004 | McDaid et al. | |
| 2015/0280370 | A1 | 10/2015 | Huang et al. | |

* cited by examiner

*Primary Examiner* — Edwin A. Leon
*Assistant Examiner* — Iman Malakooti
(74) *Attorney, Agent, or Firm* — Tamika A. Crawl-Bey

(57) ABSTRACT

A coaxial switch includes a conductive housing defining a central bore and a front plane that is oriented transverse to the central bore, a switch assembly including a stationary contact including a stationary engagement end, a stationary coupling end opposite the stationary engagement end, a movable contact including a movable engagement end, a movable coupling end opposite the movable engagement end, and a planar conductor engagement region positioned adjacent to the movable engagement end, where the movable engagement end is positionable in an engaged position and a disengaged position, and a dielectric front pad positioned between the conductive housing and the movable contact, where the dielectric front pad defines a central aperture through which the planar conductor engagement region has an unobstructed line of sight with the front plane of the conductive housing.

14 Claims, 6 Drawing Sheets

COAXIAL SWITCHES AND METHODS FOR USING THE SAME

CROSS-REFERENCE TO RELATED APPLICATIONS

This application claims priority under 35 U.S.C. § 119 of U.S. Provisional Application No. 63/085,885, filed Sep. 30, 2020, the content of which is relied upon and incorporated herein by reference in its entirety.

BACKGROUND

The present disclosure relates to coaxial switches and methods for using the same.

Coaxial switches can be used in a variety of applications. For example, in some applications coaxial switches may be utilized to test incoming signals from a coaxial cable connector assembly. Coaxial switches may also be utilized to switch between sources and/or receivers, and can be used to switch between different antennas.

BRIEF SUMMARY

However, conventional coaxial switch assemblies may require precise alignment with coaxial cable assemblies. Further, some conventional coaxial switch assemblies experience signal loss at high frequencies and/or require multiple components to isolate connections between components electrically coupled to the inner conductor of the coaxial cable and components electrically coupled to the outer conductor of the coaxial cable. Accordingly, a need exists for improved coaxial switches.

In a first aspect A1, the present disclosure provides a coaxial switch comprising a conductive housing defining a central bore extending through the conductive housing and a front plane that is oriented transverse to the central bore, a switch assembly engaged with the conductive housing, the switch assembly comprising a stationary contact comprising a stationary engagement end, a stationary coupling end opposite the stationary engagement end, a movable contact comprising a movable engagement end, a movable coupling end opposite the movable engagement end, and a planar conductor engagement region positioned adjacent to the movable engagement end, wherein the movable engagement end is positionable in an engaged position, in which the movable engagement end contacts the stationary engagement end of the stationary contact, and a disengaged position, in which the movable engagement end of the movable contact is spaced apart from the stationary engagement end of the stationary contact, and a dielectric front pad positioned between the conductive housing and the movable contact, wherein the dielectric front pad defines a central aperture through which the planar conductor engagement region has an unobstructed line of sight with the front plane of the conductive housing.

In a second aspect A2, the present disclosure provides the coaxial switch of aspect A1, wherein the stationary contact defines a stationary transition region positioned between the stationary engagement end and the stationary coupling end, and the stationary contact comprises a stationary engagement thickness at the stationary engagement end and a stationary transition thickness at the stationary transition region, wherein the stationary engagement thickness is less than the stationary transition thickness.

In a third aspect A3, the present disclosure provides the coaxial switch of aspect A2, wherein the stationary contact defines a stationary coupling thickness at the stationary coupling end, wherein the stationary coupling thickness is less than the stationary transition thickness.

In a fourth aspect A4, the present disclosure provides the coaxial switch of any of aspects A1-A3, wherein the movable contact defines a movable engagement thickness at the planar conductor engagement region and defines a movable coupling thickness at the movable coupling end, wherein the movable engagement thickness is greater than the movable coupling thickness.

In a fifth aspect A5, the present disclosure provides the coaxial switch of any of aspects A1-A4, wherein the conductive housing defines an orientation feature positioned on a surface of the conductive housing, wherein the orientation feature is positioned closer to the movable contact than the stationary contact.

In a sixth aspect A6, the present disclosure provides the coaxial switch of any of aspects A1-A5, wherein the dielectric front pad defines one or more outwardly-extending conductor retention features engaged with one of the stationary contact and the movable contact.

In a seventh aspect A7, the present disclosure provides the coaxial switch of any of aspects A1-A6, further comprising a dielectric base member, wherein the movable contact and the stationary contact are engaged with the dielectric base member.

In an eighth aspect A8, the present disclosure provides the coaxial switch of aspect A7, wherein the stationary contact defines one or more stationary engagement tabs engaged with a slot of the dielectric base member.

In a ninth aspect A9, the coaxial switch of any of aspects A1-A8, wherein the stationary contact further defines a taper positioned between the stationary engagement end and a stationary transition region.

In a tenth aspect A10, the present disclosure provides a coaxial switch comprising a conductive housing defining a central bore extending through the conductive housing, a switch assembly engaged with the conductive housing, the switch assembly comprising a stationary contact comprising a stationary engagement end, a stationary coupling end opposite the stationary engagement end, and a stationary transition region between the stationary engagement end and the stationary coupling end, wherein the stationary engagement end is positioned closer to the conductive housing than the stationary coupling end, a movable contact comprising a movable engagement end, a movable coupling end opposite the movable engagement end, and a planar conductor engagement region wherein the movable engagement end is positioned closer to the conductive housing than the movable coupling end, the planar conductor engagement region is accessible through the central bore of the conductive housing, the movable engagement end is movable between an engaged position, in which the movable engagement end contacts the stationary engagement end of the stationary contact, and a disengaged position, in which the planar conductor engagement region is spaced apart from the stationary engagement end of the stationary contact, and a dielectric base member, wherein the movable contact and the stationary contact are engaged with the dielectric base member and wherein the stationary contact and the movable contact are positioned between the dielectric base member and the conductive housing.

In an eleventh aspect A11, the present disclosure provides the coaxial switch of aspect A10, wherein the movable contact defines a movable engagement thickness at the planar conductor engagement region and defines a movable coupling thickness at the movable coupling end, wherein the movable engagement thickness is greater than the movable coupling thickness.

In a twelfth aspect A12, the present disclosure provides the coaxial switch of either of aspects A10 or A11, wherein the conductive housing defines an orientation feature positioned on a surface of the conductive housing, wherein the orientation feature is positioned closer to the movable contact than the stationary contact.

In a thirteenth aspect A13, the present disclosure provides the coaxial switch of any of aspects A10-A12, wherein the switch assembly further comprises a dielectric front pad engaged with the dielectric base member, wherein the movable contact and the stationary contact are positioned between the dielectric front pad and the dielectric base member.

In a fourteenth aspect A14, the present disclosure provides the coaxial switch of aspect A13, wherein the dielectric front pad defines one or more outwardly-extending conductor retention features engaged with one of the stationary contact and the movable contact.

In a fifteenth aspect A15, the present disclosure provides the coaxial switch of any of aspect A10-A14, wherein the stationary contact defines one or more stationary engagement tabs engaged with a slot of the dielectric base member.

In a sixteenth aspect A16, the present disclosure provides the coaxial switch of any of aspects A10-A15, wherein the stationary contact further defines a taper positioned between the stationary engagement end and the stationary transition region.

In a seventeenth aspect A17, the present disclosure provides a coaxial switch and coaxial cable connector assembly comprising a coaxial switch comprising a conductive housing defining a central bore extending through the conductive housing and a front plane that is oriented transverse to the central bore, a switch assembly engaged with the conductive housing, the switch assembly comprising a stationary contact comprising a stationary engagement end, a stationary coupling end opposite the stationary engagement end, a movable contact comprising a movable engagement end, a movable coupling end opposite the movable engagement end, and a planar conductor engagement region positioned adjacent to the movable engagement end, wherein the movable engagement end is positionable in an engaged position, in which the movable engagement end contacts the stationary engagement end of the stationary contact, and a disengaged position, in which the movable engagement end of the movable contact is spaced apart from the stationary engagement end of the stationary contact, and a dielectric front pad positioned between the conductive housing and the movable contact, wherein the dielectric front pad defines a central aperture through which the planar conductor engagement region has an unobstructed line of sight with the front plane of the conductive housing, and an outer conductor electrically coupled to the conductive housing.

In an eighteenth aspect A18, the present disclosure provides the coaxial switch and coaxial cable connector assembly of aspect A17, wherein the stationary contact defines a stationary transition region positioned between the stationary engagement end and the stationary coupling end, and the stationary contact comprises a stationary engagement thickness at the stationary engagement end and a stationary transition thickness at the stationary transition region, wherein the stationary engagement thickness is less than the stationary transition thickness.

In a nineteenth aspect A19, the present disclosure provides the coaxial switch and coaxial cable connector assembly of aspect A18, wherein the stationary contact defines a stationary coupling thickness at the stationary coupling end, wherein the stationary coupling thickness is less than the stationary transition thickness.

In a twentieth aspect A20, the present disclosure provides the coaxial switch and coaxial cable connector assembly of any of aspects A17-A19, wherein the movable contact defines a movable engagement thickness at the planar conductor engagement region and defines a movable coupling thickness at the movable coupling end, wherein the movable engagement thickness is greater than the movable coupling thickness.

Additional features and advantages of the technology disclosed in this disclosure will be set forth in the detailed description which follows, and in part will be readily apparent to those skilled in the art from the description or recognized by practicing the technology as described in this disclosure, including the detailed description which follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

Embodiments described herein are generally directed to coaxial switches including a movable contact in selective engagement with a stationary contact that can be coupled to an inner conductor of a coaxial cable connector assembly. In some embodiments, the movable contact is configured to directly contact the inner conductor of the coaxial cable connector assembly. In embodiments, coaxial switches according to the present disclosure may minimize insertion and/or return losses as compared to conventional configurations, and may be suitable to operate at frequencies to at least 30 gigahertz (GHz). These and other embodiments of coaxial switches are disclosed in greater detail herein with reference to the appended figures.

Figure 1:
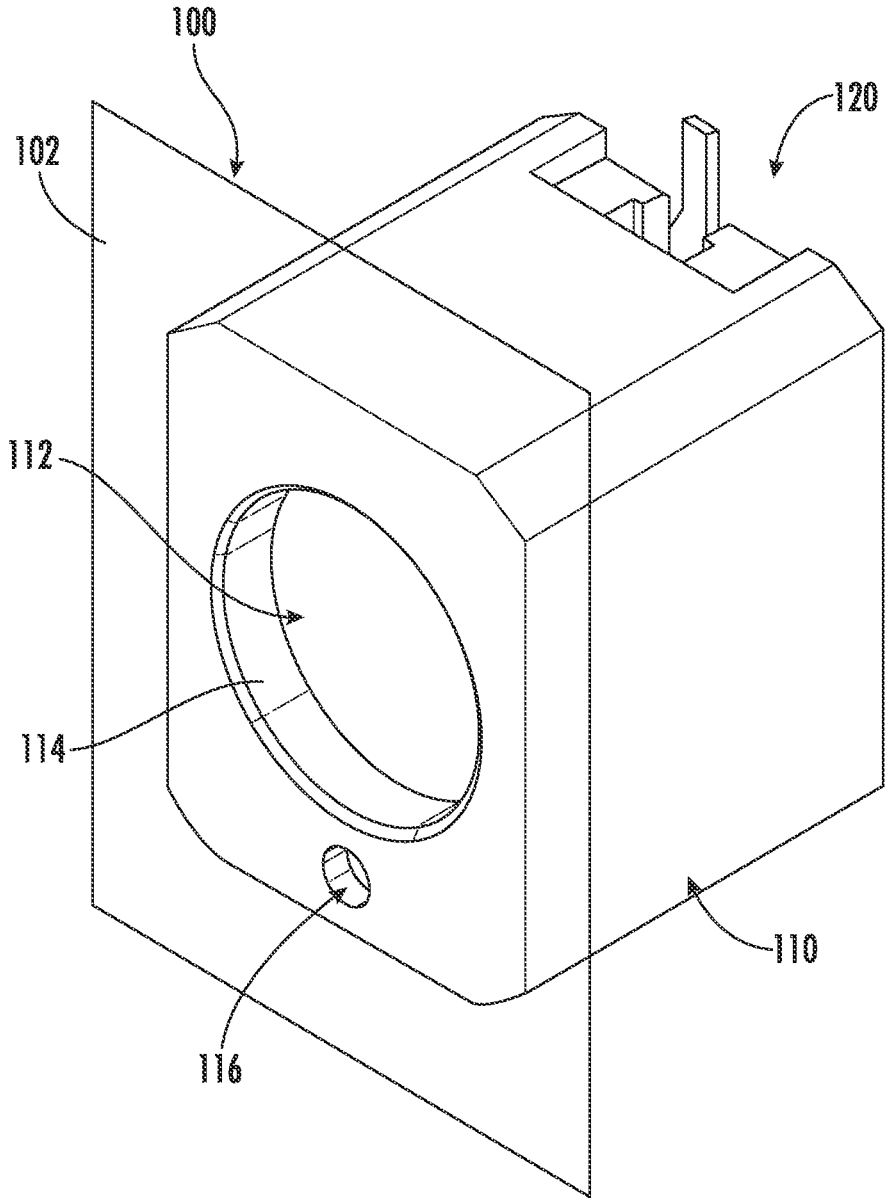
FIG. 1 schematically depicts a perspective view of a coaxial switch, according to one or more embodiments shown and described herein.

Now referring to FIG. 1, a perspective view of an example coaxial switch 100 is schematically depicted. In embodiments, the coaxial switch 100 generally includes a conductive housing 110 and a switch assembly 120 engaged with the conductive housing 110. In embodiments, the coaxial switch 100 can be coupled to and/or engaged with any suitable structure, such as a printed circuit board (PCB) or the like.

In embodiments, the conductive housing 110 generally defines a central bore 112 extending through the conductive housing 110. A coaxial cable connector assembly may be inserted at least partially within the central bore 112, as described in greater detail herein. In some embodiments the central bore 112 defines an inwardly-extending taper 114 that may assist in guiding an outer conductor of a coaxial cable connector assembly into the central bore 112 of the conductive housing 110.

In embodiments, the conductive housing 110 may be formed of an electrically-conductive material such as copper, aluminum, or the like. In some embodiments, the conductive housing 110 may have a monolithic construction (i.e., the conductive housing 110 may generally be formed of the same material or combination of materials throughout). In some embodiments, the conductive housing 110 may include a conductive outer layer, and may include an electrically-conductive or electrically non-conductive material positioned beneath the conductive outer layer.

Figure 2:
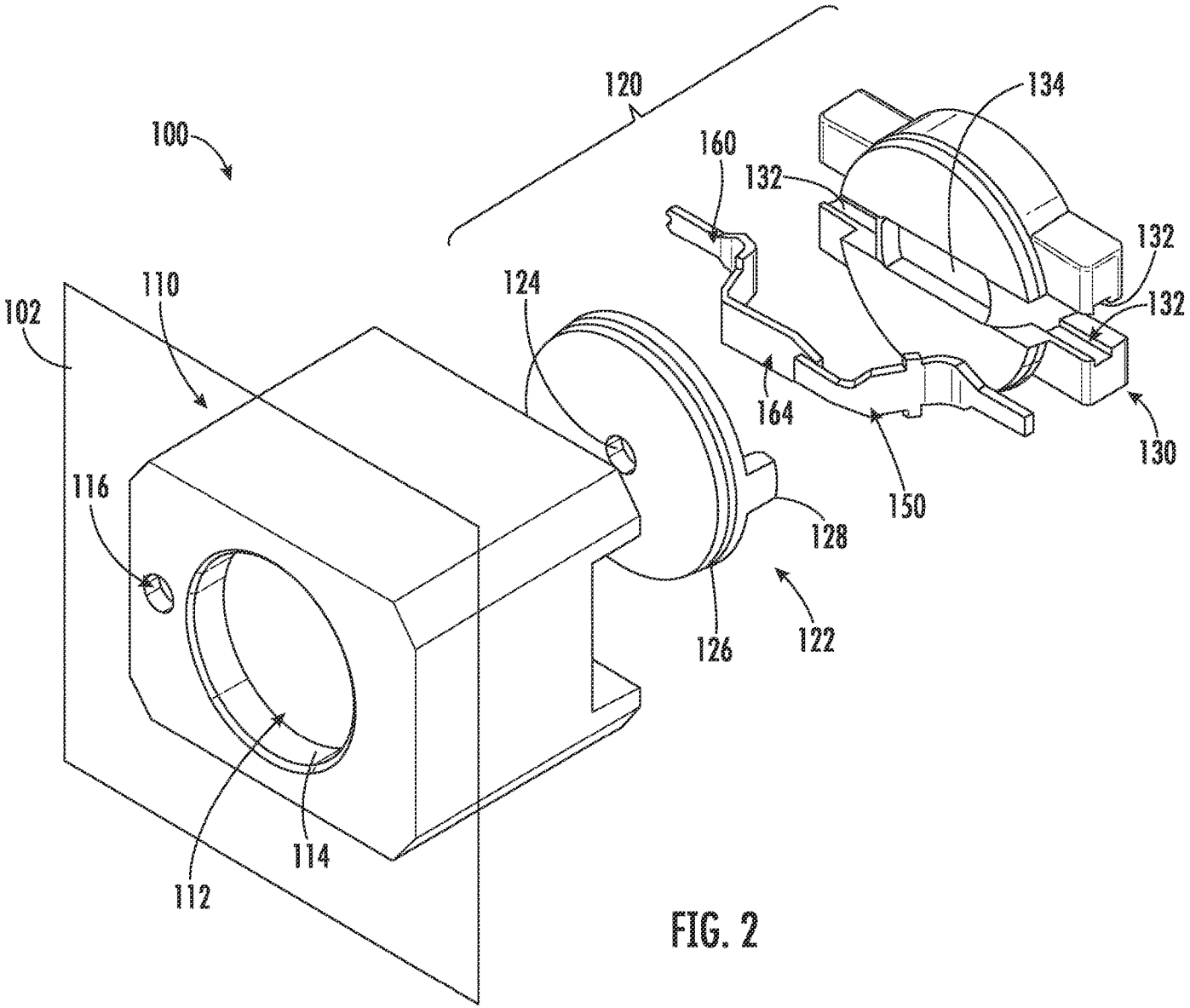
FIG. 2 schematically depicts an exploded view of the coaxial switch of FIG. 1, according to one or more embodiments shown and described herein.

Referring to FIG. 2, an exploded perspective view of the coaxial switch 100 is schematically depicted. In embodiments, the switch assembly 120 generally includes a dielectric front pad 122, a stationary contact 150, a movable contact 160, and a dielectric base member 130.

In some embodiments, the conductive housing 110 may define an orientation feature 116 positioned on a surface of the conductive housing 110, where the orientation feature 116 is positioned closer to the movable contact 160 than the stationary contact 150. The orientation feature 116 may assist a user, such as a technician, in identifying a position of the movable contact 160.

In embodiments, the dielectric front pad 122 and the dielectric base member 130 may be engaged with and/or coupled to one another, and the stationary contact 150 and the movable contact 160 may be positioned between the dielectric base member 130 and the dielectric front pad 122. In embodiments, the dielectric front pad 122 is positioned between the conductive housing 110 and the movable contact 160, and positioned between the conductive housing 110 and the stationary contact 150. By positioning the dielectric front pad 122 between the conductive housing 110 and the movable contact 160, electrical current may be restricted from flowing between the conductive housing 110 and the movable contact 160. Similarly, by positioning the dielectric front pad 122 between the conductive housing 110 and the stationary contact 150, electrical current may be restricted from flowing between the conductive housing 110 and the stationary contact 150. The dielectric front pad 122, in some embodiments, defines a central aperture 124 extending through the dielectric front pad 122. At least a portion of the movable contact 160 may be accessible thorough the central aperture 124, as described in greater detail herein, and in embodiments, a central conductor of a coaxial cable connector assembly may be inserted through the central aperture 124.

The dielectric front pad 122, in some embodiments, may further include a housing engagement feature 126. The housing engagement feature 126 may couple the dielectric front pad 122 to the conductive housing 110, and may include a ridge or the like that has an interference fit with the conductive housing 110. In some embodiments, the dielectric front pad 122 may further include one or more outwardly-extending conductor retention features 128. The one or more outwardly-extending conductor retention features 128 may engage the stationary contact 150 and/or the movable contact 160, retaining the stationary contact 150 or the movable contact 160 between the dielectric front pad 122 and the dielectric base member 130.

In embodiments, the dielectric front pad 122 may be formed of any suitable dielectric material that resists the transmission of electrical current, for example and without limitation, a polymer or the like.

The dielectric base member 130 generally defines an inwardly-extending cavity 134. In embodiments, the stationary contact 150 and the movable contact 160 may be positioned at least partially within the inwardly-extending cavity 134 of the dielectric base member 130. The dielectric base member 130 may also include one or more slots 132 positioned along the inwardly-extending cavity 134. In some embodiments, the stationary contact 150 and/or the movable contact 160 may engage the one or more slots 132, and the one or more slots 132 may retain the stationary contact 150 and/or the movable contact 160.

In embodiments, the dielectric base member 130 is formed of a dielectric material that resists the transmission of current, for example and without limitation, a polymer or the like. The dielectric base member 130, in embodiments, may be formed of the same material as the dielectric front pad 122, or may be formed of a different material.

Figure 3A:
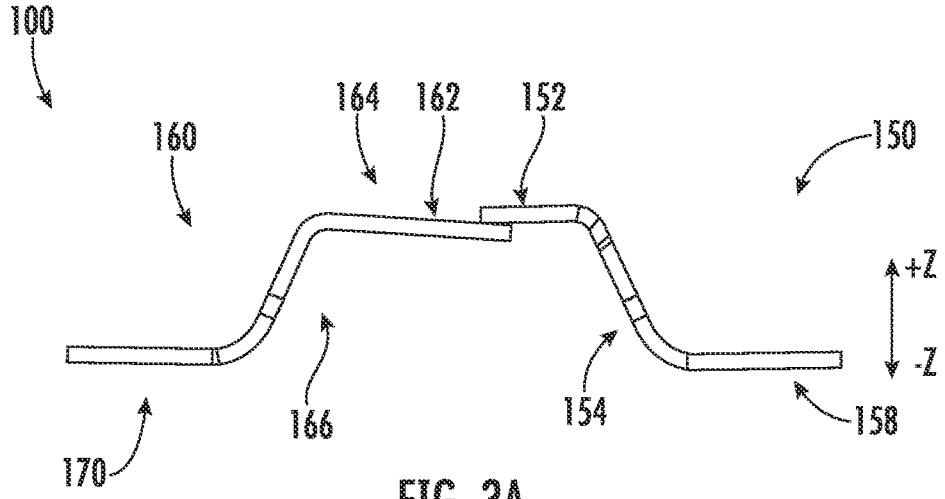
FIG. 3A schematically depicts a side view of a stationary contact and a movable contact of the coaxial switch of FIG. 1, according to one or more embodiments shown and described herein.
Figure 3B:
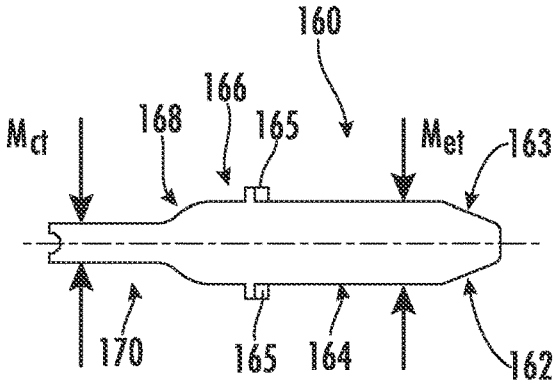
FIG. 3B schematically depicts a top view of the movable contact of FIG. 3A, according to one or more embodiments shown and described herein.
Figure 3C:
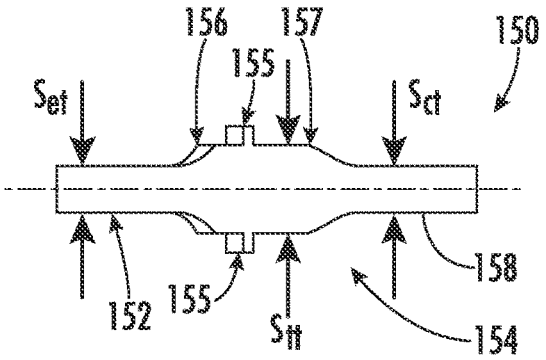
FIG. 3C schematically depicts a top view of the stationary contact of FIG. 3A, according to one or more embodiments shown and described herein.

Referring to FIGS. 3A, 3B, and 3C, the movable contact 160 and the stationary contact 150 are schematically depicted. Referring particularly to FIGS. 3A and 3B, a side view and a top view of the movable contact 160 are schematically depicted. In embodiments, the movable contact 160 extends between a movable engagement end 162 and a movable coupling end 170 positioned opposite the movable engagement end 162.

In embodiments, the movable contact 160 defines a planar conductor engagement region 164 positioned adjacent to the movable engagement end 162. The planar conductor engagement region 164, in embodiments, is configured to engage an inner conductor or a coaxial cable connector assembly, as described in greater detail herein. In some embodiments at least a portion of the planar conductor engagement region 164 may also be engageable with the stationary contact 150.

The movable contact 160 defines a movable transition region 166 positioned between the planar conductor engagement region 164 and the movable coupling end 170. In embodiments, a height of the movable contact 160 (e.g., evaluated in the +/−Z-direction depicted in FIG. 3A) changes along the movable transition region 166. In the embodiment depicted in FIG. 3A, the planar conductor engagement region 164 is positioned above the movable coupling end 170. By positioning the planar conductor engagement region 164 above the movable coupling end 170, a distance between the planar conductor engagement region 164 and an inner conductor of a coaxial cable assembly inserted into the coaxial switch 100 may be reduced. In embodiments, the movable contact 160 has a movable engagement thickness $M_{et}$ at the movable engagement end 162 and/or the movable transition region 166 and a movable coupling thickness $M_{ct}$ at the movable coupling end 170, where the movable engagement thickness $M_{et}$ is greater than the movable coupling thickness $M_{ct}$. The movable contact 160 may further a taper 168 between the movable coupling end 170 and the movable transition region 166. In embodiments, the movable contact 160 may further define a taper 163 at the movable engagement end 162.

Referring to FIGS. 2, 3A, and 3B, in embodiments, the planar conductor engagement region 164 enjoys an unobstructed line of sight with a front plane 102 of the conductive housing 110. For example, in embodiments, the planar conductor engagement region 164 of the movable contact 160 enjoys an unobstructed line of sight with the front plane 102 of the conductive housing 110 through the central aperture 124 of the dielectric front pad 122 and the central bore 112 of the conductive housing 110. Because the planar conductor engagement region 164 of the movable contact 160 has an unobstructed line of sight with the front plane 102, the planar conductor engagement region 164 is accessible through the central bore 112 of the conductive housing 110 by an inner conductor of a coaxial cable connector assembly inserted into the conductive housing 110, as described in greater detail herein. By directly engaging the inner conductor of a coaxial cable connector assembly inserted into the conductive housing 110, signal loss between the movable contact 160 and the inner conductor of the coaxial cable connector assembly can be minimized. Further, because the movable contact 160 is directly engageable with the inner conductor of the coaxial cable connector assembly without intermediate connecting components, manufacturing costs of the coaxial switch 100 may be reduced as compared to configurations that include intermediate connecting components. Moreover, because the movable contact 160 is directly engageable with the inner conductor of the coaxial cable connector assembly, the coaxial switch 100 may have a comparatively small profile as compared to conventional coaxial switches, such that the coaxial switch 100 may be used in applications requiring compact coaxial switches.

In some embodiments, the movable contact 160 further includes one or more movable engagement tabs 165 extending outwardly from the movable contact 160. The one or more movable engagement tabs 165 may be engaged with the one or more slots 132 to couple the movable contact 160 to the dielectric base member 130.

In embodiments, the stationary contact 150 extends between a stationary engagement end 152 and a stationary coupling end 158 opposite the stationary engagement end 152. The stationary engagement end 152, in embodiments, is in selective engagement with the movable contact 160. Through engagement with the movable contact 160, the stationary contact 150 and the movable contact 160 are selectively electrically coupled, such that electrical current can pass between the movable contact 160 and the stationary contact 150. In embodiments, the movable engagement end 162 of the movable contact 160 is positionable in an engaged position, in which the movable engagement end 162 of the movable contact 160 contacts the stationary engagement end 152 of the stationary contact 150, as shown in FIG. 3A. The movable engagement end 162 of the movable contact 160 is movable from the engaged position to a disengaged position, in which the movable engagement end 162 of the movable contact 160 is spaced apart from the stationary engagement end 152 of the stationary contact 150. In embodiments, the movable engagement end 162 of the movable contact 160 may be moved out of engagement with the stationary engagement end 152 of the stationary contact 150 through engagement with an inner conductor of a coaxial cable connector assembly, as described in greater detail herein. With the movable engagement end 162 of the movable contact 160 spaced apart from the stationary engagement end 152 of the stationary contact 150, the movable contact 160 may be electrically disconnected from the stationary contact 150.

In embodiments, the stationary contact 150 defines a stationary transition region 154 positioned between the stationary engagement end 152 and the stationary coupling end 158. In embodiments a height of the stationary contact 150 (e.g., evaluated in the +/−Z-direction as depicted in FIG. 3A) changes along the stationary transition region 154. In the embodiment depicted in FIG. 3A, the stationary engagement end 152 is positioned above the stationary coupling end 158.

In embodiments the stationary contact 150 has a stationary transition thickness $S_{ct}$ at the stationary transition region 154 and a stationary engagement thickness $S_{et}$ at the stationary engagement end 152 where the stationary engagement thickness $S_{et}$ is less than the stationary transition thickness $S_{tt}$. For example, in some embodiments, the stationary contact 150 defines a taper 156 positioned between the stationary engagement end 152 and the stationary transition region 154. In some embodiments, the stationary contact 150 has a stationary coupling thickness $S_{ct}$ at the stationary coupling end 158, where the stationary coupling thickness $S_{ct}$ is less than the stationary transition thickness $S_{tt}$. In some embodiments, the stationary contact 150 further includes a taper 157 positioned between the stationary transition region 154 and the stationary coupling end 158.

In some embodiments, the stationary contact 150 includes one or more stationary engagement tabs 155 extending outwardly from the stationary contact 150. The one or more stationary engagement tabs 155 may be engaged with the one or more slots 132 (FIG. 2) to couple the stationary contact 150 to the dielectric base member 130 (FIG. 2). In embodiments, the shapes of the stationary contact 150 and the movable contact 160 (e.g., the stationary transition region 154, the movable transition region 166, the planar conductor engagement region 164, etc.) may reduce signal loss along the stationary contact 150 and the movable contact 160.

Figure 4:
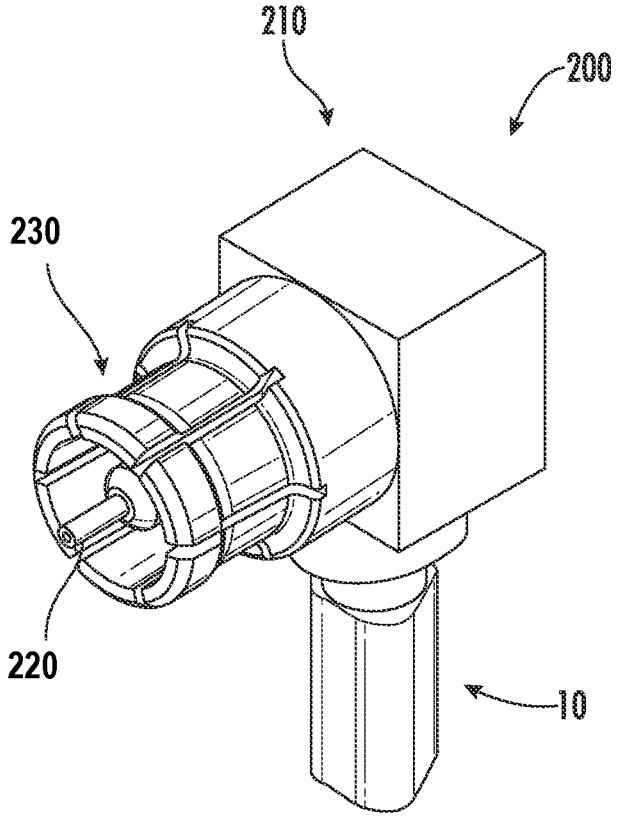
FIG. 4 schematically depicts a perspective view of a coaxial cable connector assembly, according to one or more embodiments shown and described herein.

Referring to FIG. 4, a perspective view of a coaxial cable connector assembly 200 is schematically depicted. In embodiments, the coaxial cable connector assembly 200 generally includes a housing 210, an inner conductor 220, and an outer conductor 230. In embodiments, the inner conductor 220 of the coaxial cable connector assembly 200 is electrically coupled to an inner conductor of a coaxial cable 10 engaged with the coaxial cable connector assembly 200. The outer conductor 230 of the coaxial cable connector assembly 200, in embodiments, is electrically coupled to an outer conductor of the coaxial cable 10. In the embodiment depicted in FIG. 4, the coaxial cable connector assembly 200 is a right-angle connector (e.g., a connector in which the coaxial cable 10 is oriented transverse to the inner conductor 220 and the outer conductor 230), however, it should be understood that this is merely an example. Coaxial cable connector assemblies 200 according to the present disclosure may include any suitable connector, for example a straight coaxial cable connector.

Figure 5:
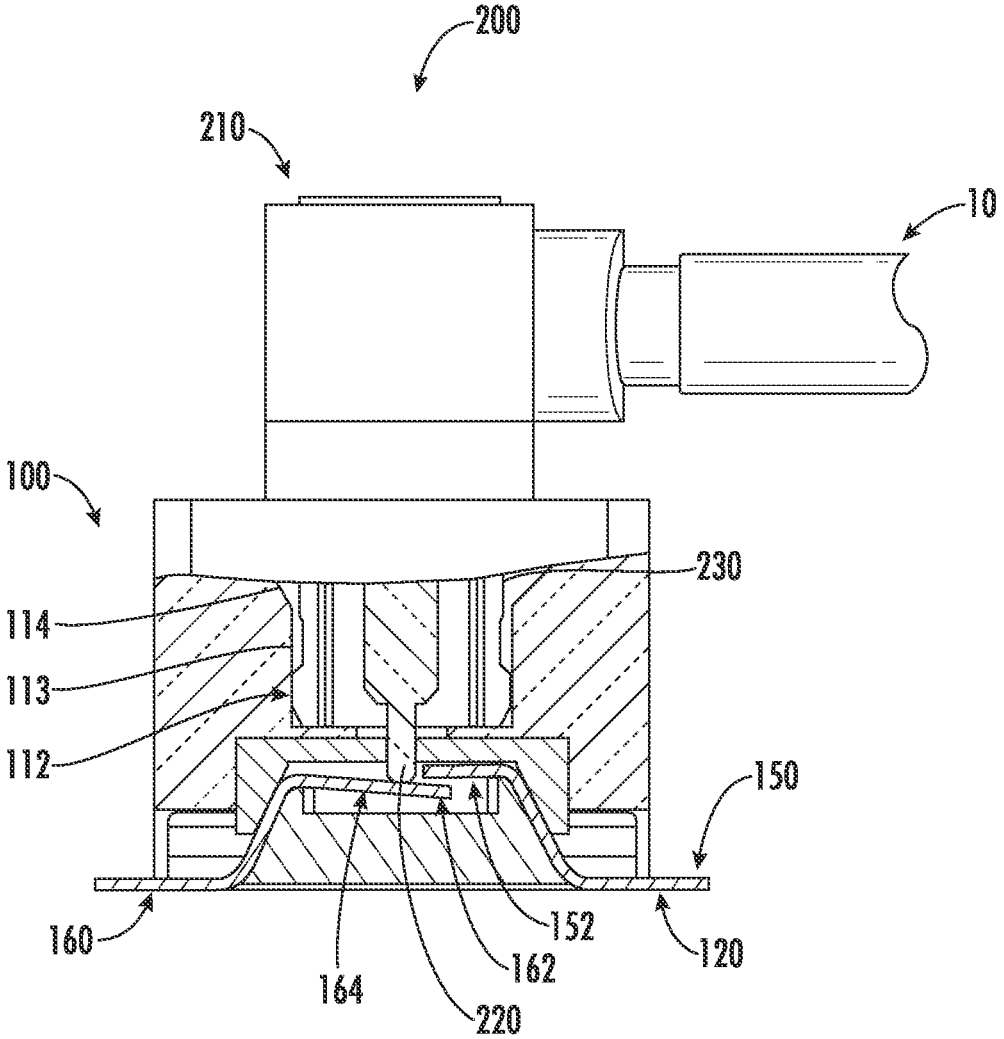
FIG. 5 schematically depicts the coaxial cable connector assembly of FIG. 5 engaged with the coaxial switch of FIG. 1, according to one or more embodiments shown and described herein.

Referring to FIG. 5, a section view of the coaxial switch 100 is schematically depicted with the coaxial cable connector assembly 200. As the coaxial cable connector assembly 200 is inserted into the coaxial switch 100, the outer conductor 230 of the coaxial cable connector assembly 200 engages the conductive housing 110 of the coaxial switch 100. In embodiments, the outer conductor 230 of the coaxial cable connector assembly 200 may be electrically coupled to the conductive housing 110, for example through contact with an inner wall 113 of the central bore 112.

As the coaxial cable connector assembly 200 is inserted into the coaxial switch 100, the inner conductor 220 of the coaxial cable connector assembly 200 engages the movable contact 160. For example, in the embodiment depicted in FIG. 5, the inner conductor 220 of the coaxial cable connector assembly 200 engages the planar conductor engagement region 164 of the movable contact 160.

With the inner conductor 220 of the coaxial cable connector assembly 200 engaged with the planar conductor engagement region 164 of the movable contact 160, the inner conductor 220 of the coaxial cable connector assembly 200 may move the movable contact 160 into the disengaged position with respect to the stationary contact 150. In particular, as the inner conductor 220 of the coaxial cable connector assembly 200 is inserted into the coaxial switch 100, the inner conductor 220 deflects the planar conductor engagement region 164 and the movable engagement end 162 away from the stationary engagement end 152 of the stationary contact 150. As the movable engagement end 162 of the movable contact 160 disengages the stationary engagement end 152 of the stationary contact 150, the movable contact 160 and the stationary contact 150 are electrically de-coupled from one another.

Through engagement with the inner conductor 220 of the coaxial cable connector assembly 200, the movable contact 160 is electrically coupled to the inner conductor 220 of the coaxial cable connector assembly 200. In this way, by inserting the coaxial cable connector assembly 200, the movable contact 160 is electrically de-coupled from the stationary contact 150 and is electrically coupled to the inner conductor 220 of the coaxial cable connector assembly 200. The coaxial cable connector assembly 200 is removable from the coaxial switch 100, and as the inner conductor 220 is removed from the coaxial switch 100, the movable contact 160 may re-engage the stationary contact 150 such that the movable contact 160 and the stationary contact 150 are again electrically coupled to one another. By selectively electrically coupling the inner conductor 220 to the movable contact 160 of the coaxial cable connector assembly 200, the movable contact 160 may be utilized to test an incoming signal from the inner conductor 220. In these configurations, the orientation feature 116 (FIG. 2) may assist a user, such as a technician, in identifying a position of the movable contact 160, such that the user may engage the movable contact 160 to test the incoming signal from the movable conductor 160 through the inner contact 220.

In some configurations, antennas (not depicted) may be electrically coupled to the inner conductor 220 of the coaxial cable connector assembly 200. By selectively electrically coupling the movable contact 160 to the inner conductor 220 of the coaxial cable connector assembly 200 and the stationary contact 150, the movable contact 160 may alternately connect with the antenna electrically coupled to the inner conductor 220 of the coaxial cable connector assembly 200 and the antenna electrically coupled to the stationary contact 150.

Figure 6:
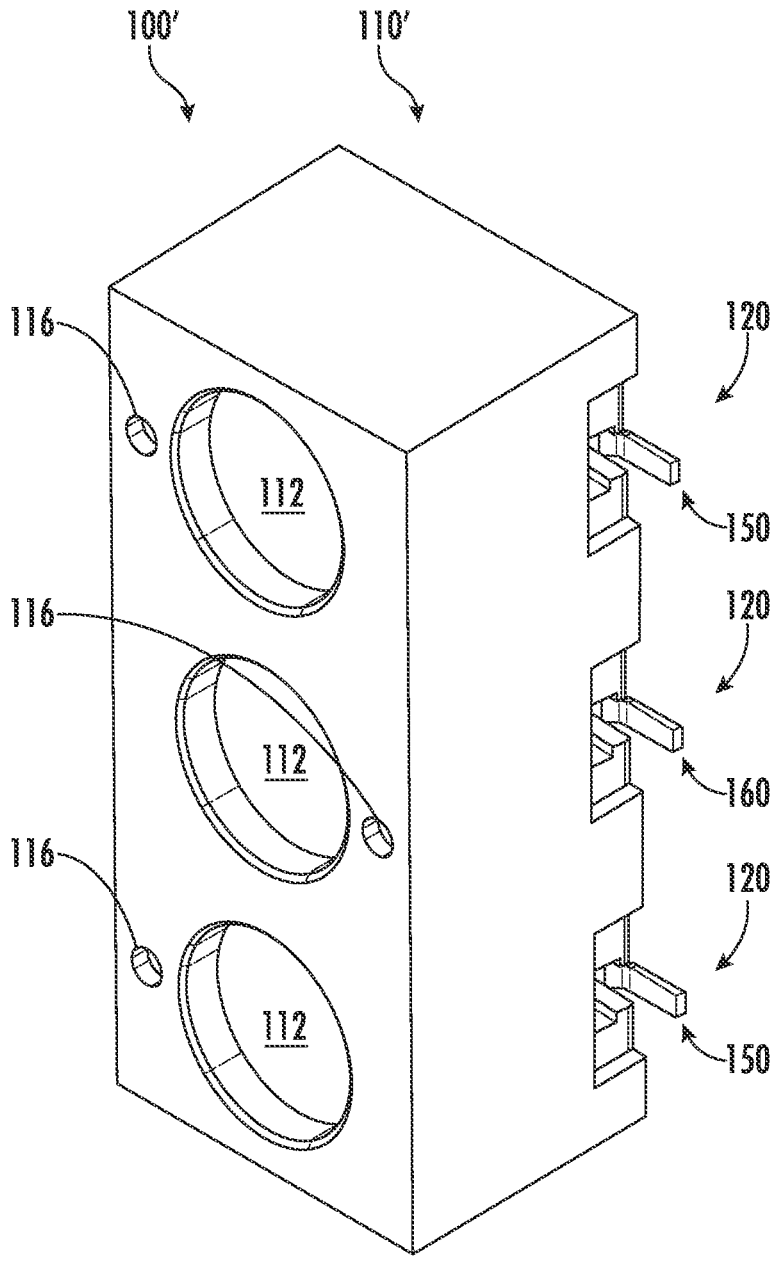
FIG. 6 schematically depicts a perspective view of another coaxial switch, according to one or more embodiments shown and described herein.

Referring to FIG. 6, a perspective view of another embodiment of the coaxial switch 100' is depicted. In some embodiments, the conductive housing 110' may include multiple central bores 112, and multiple switch assemblies 120 associated with the central bores 112. While in the embodiment depicted in FIG. 6, the conductive housing 110' includes three central bores 112 and associated switch assemblies 120, it should be understood that conductive housings 110' according to the present disclosure may include any suitable number of switch assemblies 120 and central bores 112. Further, while in the embodiment depicted in FIG. 6, the movable contacts 160 and stationary contacts 150 of the switch assemblies 120 are alternately arranged, it should be understood that this is merely an example.

Having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the appended claims should be taken as the sole representation of the breadth of the present disclosure and the corresponding scope of the various embodiments described in this disclosure. Further, it should be apparent to those skilled in the art that various modifications and variations can be made to the described embodiments without departing from the spirit and scope of the claimed subject matter. Thus, it is intended that the specification cover the modifications and variations of the various described embodiments provided such modification and variations come within the scope of the appended claims and their equivalents.

It is noted that recitations herein of a component of the present disclosure being "structurally configured" in a particular way, to embody a particular property, or to function in a particular manner, are structural recitations, as opposed to recitations of intended use. More specifically, the references herein to the manner in which a component is "structurally configured" denotes an existing physical condition of the component and, as such, is to be taken as a definite recitation of the structural characteristics of the component.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

For the purposes of describing and defining the present invention it is noted that the terms "substantially" and "about" are utilized herein to represent the inherent degree of uncertainty that may be attributed to any quantitative comparison, value, measurement, or other representation. The terms "substantially" and "about" are also utilized herein to represent the degree by which a quantitative representation may vary from a stated reference without resulting in a change in the basic function of the subject matter at issue.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A coaxial switch comprising:

a conductive housing defining a central bore extending through the conductive housing and a front plane that is oriented transverse to the central bore;

a switch assembly engaged with the conductive housing, the switch assembly comprising:

a stationary contact comprising a stationary engagement end, a stationary coupling end opposite the stationary engagement end;

a movable contact comprising a movable engagement end, a movable coupling end opposite the movable engagement end, and a planar conductor engagement region positioned adjacent to the movable engagement end, wherein the movable engagement end is positionable in an engaged position, in which the movable engagement end contacts the stationary engagement end of the stationary contact, and a disengaged position, in which the movable engagement end of the movable contact is spaced apart from the stationary engagement end of the stationary contact; and a dielectric front pad positioned between the conductive housing and the movable contact, wherein the dielectric front pad defines a central aperture through which the planar conductor engagement region has an unobstructed line of sight with the front plane of the conductive housing, wherein the conductive housing defines an orientation feature positioned on a surface of the conductive housing, wherein the orientation feature is positioned closer to the movable contact than the stationary contact.

2. The coaxial switch of claim 1, wherein the stationary contact defines a stationary transition region positioned between the stationary engagement end and the stationary coupling end, and the stationary contact comprises a stationary engagement thickness at the stationary engagement end and a stationary transition thickness at the stationary transition region, wherein the stationary engagement thickness is less than the stationary transition thickness.

3. The coaxial switch of claim 2, wherein the stationary contact defines a stationary coupling thickness at the stationary coupling end, wherein the stationary coupling thickness is less than the stationary transition thickness.

4. The coaxial switch of claim 1, wherein the movable contact defines a movable engagement thickness at the planar conductor engagement region and defines a movable coupling thickness at the movable coupling end, wherein the movable engagement thickness is greater than the movable coupling thickness.

5. The coaxial switch of claim 1, wherein the dielectric front pad defines one or more outwardly-extending conductor retention features engaged with one of the stationary contact and the movable contact.

6. The coaxial switch of claim 1, further comprising a dielectric base member, wherein the movable contact and the stationary contact are engaged with the dielectric base member.

7. The coaxial switch of claim 6, wherein the stationary contact defines one or more stationary engagement tabs engaged with a slot of the dielectric base member.

8. The coaxial switch of claim 1, wherein the stationary contact further defines a taper positioned between the stationary engagement end and a stationary transition region.

9. A coaxial switch comprising:

a conductive housing defining a central bore extending through the conductive housing;

a switch assembly engaged with the conductive housing, the switch assembly comprising:

a stationary contact comprising a stationary engagement end, a stationary coupling end opposite the stationary engagement end, and a stationary transition region between the stationary engagement end and the stationary coupling end, wherein the stationary engagement end is positioned closer to the conductive housing than the stationary coupling end;

a movable contact comprising a movable engagement end, a movable coupling end opposite the movable engagement end, and a planar conductor engagement region wherein:

the movable engagement end is positioned closer to the conductive housing than the movable coupling end;

the planar conductor engagement region is accessible through the central bore of the conductive housing;

the movable engagement end is movable between an engaged position, in which the movable engagement end contacts the stationary engagement end of the stationary contact, and a disengaged position, in which the planar conductor engagement region is spaced apart from the stationary engagement end of the stationary contact; and a dielectric base member, wherein the movable contact and the stationary contact are engaged with the dielectric base member and wherein the stationary contact and the movable contact are positioned between the dielectric base member and the conductive housing, wherein the conductive housing defines an orientation feature positioned on a surface of the conductive housing, wherein the orientation feature is positioned closer to the movable contact than the stationary contact.

10. The coaxial switch of claim 9, wherein the movable contact defines a movable engagement thickness at the planar conductor engagement region and defines a movable coupling thickness at the movable coupling end, wherein the movable engagement thickness is greater than the movable coupling thickness.

11. The coaxial switch of claim 9, wherein the switch assembly further comprises a dielectric front pad engaged with the dielectric base member, wherein the movable contact and the stationary contact are positioned between the dielectric front pad and the dielectric base member.

12. The coaxial switch of claim 11, wherein the dielectric front pad defines one or more outwardly-extending conductor retention features engaged with one of the stationary contact and the movable contact.

13. The coaxial switch of claim 9, wherein the stationary contact defines one or more stationary engagement tabs engaged with a slot of the dielectric base member.

14. The coaxial switch of claim 9, wherein the stationary contact further defines a taper positioned between the stationary engagement end and the stationary transition region.

* * * * *